US005941381A

United States Patent [19]

James

[11] Patent Number: 5,941,381

[45] Date of Patent: Aug. 24, 1999

[54] UTILITY CARRY ALL

[76] Inventor: Richard L. James, P.O. Box 180756, Mobile, Ala. 36618

[21] Appl. No.: 09/130,125

[22] Filed: Aug. 6, 1998

[51] Int. Cl.[6] ..... B65D 25/24; B65D 25/32

[52] U.S. Cl. ..... 206/229; 206/446; 220/23.4; 220/632; 220/773

[58] Field of Search ..... 206/223, 225, 206/229, 372, 373, 446; 220/23.4, 23.88, 632, 636, 773, 776

[56] References Cited

U.S. PATENT DOCUMENTS

| | | | |
|---|---|---|---|
| 2,949,203 | 8/1960 | Berg | 220/23.4 |
| 3,353,117 | 11/1967 | Edwards | 220/23.4 |
| 3,887,103 | 6/1975 | Spooner | 220/20 |
| 3,907,105 | 9/1975 | Nowak | 206/216 |
| 4,887,713 | 12/1989 | Tupper | 206/229 |
| 4,895,256 | 1/1990 | Johnston | 206/501 |
| 5,035,321 | 7/1991 | Denton | 206/229 |
| 5,086,917 | 2/1992 | Dziersk et al. | 206/216 |
| 5,370,263 | 12/1994 | Brown | 220/751 |
| 5,544,744 | 8/1996 | Oman | 206/319 |

*Primary Examiner*—Jim Foster
*Attorney, Agent, or Firm*—Joseph N. Breaux

[57] ABSTRACT

A Utility Carry All for transporting numerous spray bottles in connection with a fluid handling or transporting central container having a handle positioned for balanced transport. The Utility Carry All includes a number of bottle neck size adapter inserts that fit into numerous longitudinal bottle mount openings positioned along the sides of the central transporting container and allow a user to insert a specific adapter size for a particular size spray bottle neck size. The adapter inserts snap into place and can be removed or changed to different bottle sizes. The utility carry all is provided with numerous bottle neck adapters so that the carry all can be customized by the user to carry desired bottles.

5 Claims, 2 Drawing Sheets

UTILITY CARRY ALL

DESCRIPTION

1. Technical Field

The present invention relates to devices and methods for a handheld utility carry all and more particularly to devices and methods for a handheld utility carry all for carrying cleaning solution spray bottles in connection with a cleaning supply carrying container having a handle wherein the utility carry all includes a number of bottle neck adapter inserts that fit into longitudinal openings along the sides of the carry all and allow a user to insert an adapter required for a particular size plastic spray bottle neck, the adapter inserts snap into place and can be removed or changed to different sizes when needed.

2. Background Art

Numerous devices have been developed for transporting cleaning supplies such as bottles of cleaning solutions, soaps, disinfectants, sponges, towels, and the like. Some of these prior devices include a handle for carrying the device, and include different compartments for separating the materials transported. Prior devices of this general type are disclosed for example in U.S. Pat. Nos. 5,544,744, 5,370,263, 5,086,917, 4,895,256, 3,907,105, and 3,887,103.

The prior art devices are useful for their stated purposes and include means for transporting liquid along with various cleaning supplies or transporting various cleaning supplies separate from a liquid transporting bucket. However, these devices do not provide a device which allows numerous spray bottles to be carried with the carry all from a bottle neck support designed to be adaptable to accommodate a variety of bottle neck sizes and which allows for efficient retrieval of spray bottles. Furthermore, prior to the present invention the prior art has not provided a device which includes a number of bottle carrying inserts which may be changed to accommodate different bottle neck sizes and which therefore are adaptable to fit any size cleaning bottle neck and which cleaning bottle inserts are positioned longitudinally around a main storage compartment which may be utilized for transporting liquid and/or any other cleaning supplies necessary along with the bottles. The present invention provides a user with a means for customizing the utility carry all with bottle inserts as desired. Furthermore, the present invention provides a bottle transporting and cleaning supply transporting device which neatly organizes cleaning solution bottles which are easily accessible by the user thereby increasing the efficiency of a cleaning person's operations.

The utility carry all is manufactured of durable plastic and molded as a single piece with various sized bottle neck size adapters so that a user can customize the carry all to fit his or her particular needs. The utility carry all also includes a centrally located container area which may be utilized to transport either liquids or any other cleaning supplies necessary.

GENERAL SUMMARY DISCUSSION OF INVENTION

It is thus an object of the invention to provide a Utility Carry All that provides a means for carrying spray bottles in connection with a fluid handling or cleaning supply transporting container having a handle wherein the utility carry all includes a number of bottle neck size adapter inserts that fit into numerous longitudinal openings positioned along the sides of the carry all and allow a user to have quick access to bottles and further allows a user to insert the bottle neck size adapter inserts required for particular bottle neck size, while the adapter inserts are snapped into place and may be removed or changed to accommodate different bottle neck sizes when needed.

It is a further object of the invention to provide a Utility Carry All that includes a centrally located container for transporting liquid cleaning solution while numerous bottle transport inserts are positioned along the perimeter of the centrally located container.

It is a still further object of the invention to provide a Utility Carry All that includes a centrally located container with numerous longitudinally placed bottle transport inserts positioned on the perimeter of the centrally located container, a handle extends over the utility carry all and is positioned for balanced transport of the device while a number of rubber pad feet are positioned on the bottom of the device which prevent the device from displacing inadvertently while sitting on an uneven slippery surface.

It is a still further object of the invention to provide a Utility Carry All that provides a means for transporting numerous spray bottles along with other cleaning supplies and maintains the bottles in an organized manner for efficient retrieval thus increasing the efficiency of a cleaning operation.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that anyone who desires to carry necessary cleaning supplies including cleaning chemicals would simply place an appropriate sized bottle neck size adapter, for a bottle to be transported, into a bottle neck receiver on the utility carry all and likewise repeat this for each bottle desired to be Transported which may number up to six spray bottles, or other non-spray bottles. Miscellaneous cleaning supplies such as rags, brushes, sponges, etc., or alternatively cleaning liquid solution, is then placed into the centrally located container and then all supplies are transported to the location to be cleaned. The utility carry all would provide an inexpensive, convenient, and efficient method of allowing the user to easily carry, retrieve, and store all required cleaning supplies in a fashion where they would not only be accessible at all times but which would also prevent transported liquid containers from breaking or spilling. The use of this utility carry all would also be especially beneficial to those individuals who make their living in the cleaning industry as it would enable these persons to work more efficiently thereby saving time and increasing productivity.

Figure 1:
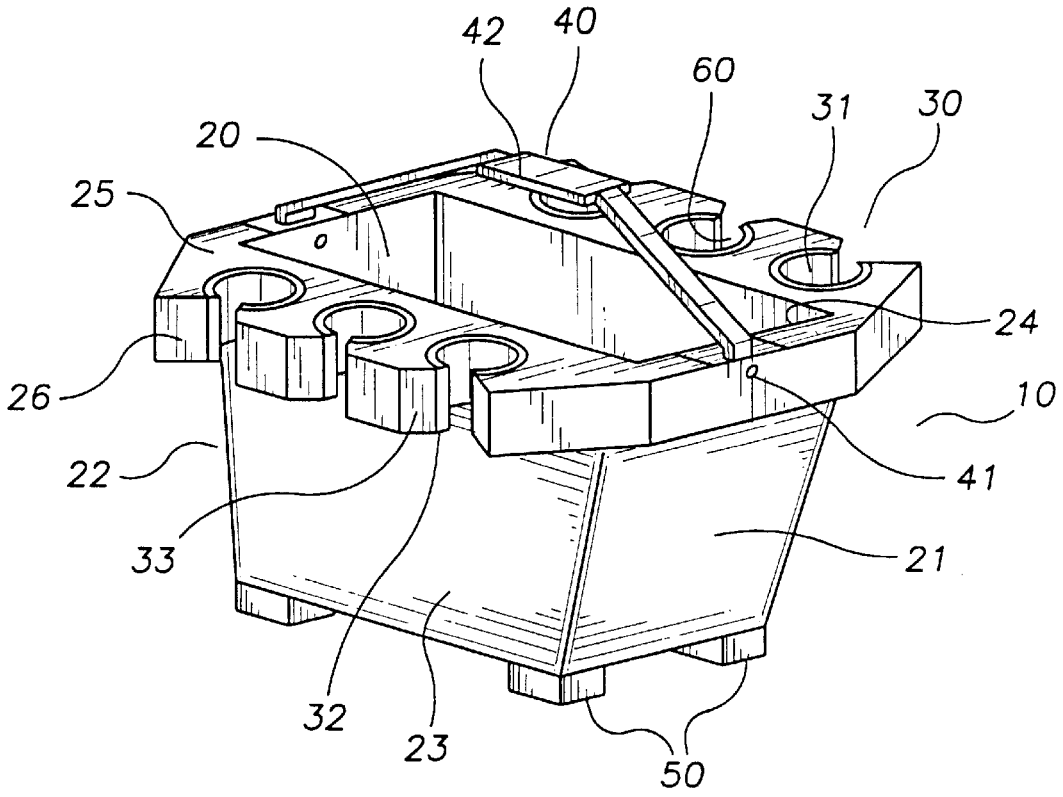
FIG. 1 is an isometric view of the utility carry all.
Figure 2:
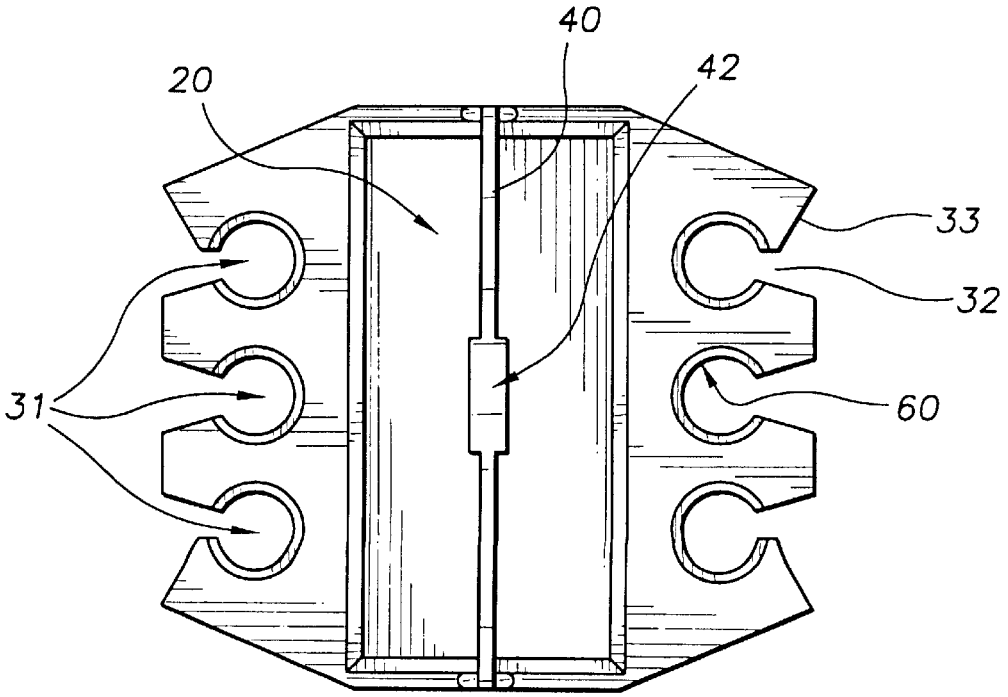
FIG. 2 is a top view of the utility carry all illustrating the positioning of the bottle neck inserts on two sides of a rectangular shaped centrally located container with a centrally positioned carrying handle.
Figure 4:
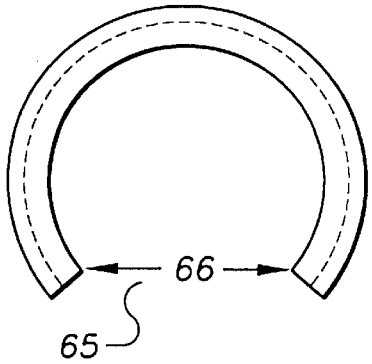
FIG. 4 is a top view of a bottle neck insert size adapter.
Figure 5:
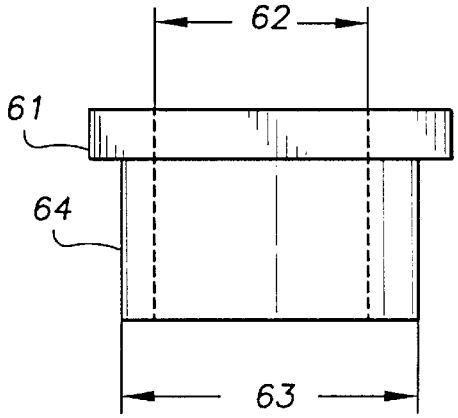
FIG. 5 is a side view of a bottle neck side size adapter.

Referring to the figures in detail FIG. 1 is an isometric view of the utility carry all 10 which includes a centrally located container 20, numerous bottle mounts 30, a centrally positioned carrying handle 40, rubber pad feet 50 and bottle neck inserts 60. The utility carry all 10 is preferably constructed of heavy duty durable plastic and constructed utilizing a manufacturing method which would allow the entire device to be molded as one piece excluding the centrally located handle 40, the rubber pad feet 50, and the bottle neck inserts 60. As illustrated in FIG. 1 the utility carry all 10 is shown constructed in the general shape of a rectangle, this shape is not mandatory and may be shaped square, round, or any other geometric configuration which would be useful. The centrally located container 20 is preferably rectangular in shape, includes a front end 21, a rear end 22, sides 23 and a top edge 24 around the entire perimeter of the centrally located container 20. The depth of the central container 20 is between eight and twelve inches tall, and about six to about twelve inches wide and about eight to about twelve inches long. A centrally located handle 40 is attached from a top edge 24 of the front end 21 to a top edge 24 of the rear end 22 of the central container 20 and is attached by use of an attachment pin 41 on both ends. The carrying handle 40 also includes a contoured grip 42 for easy gripping the handle. The carrying handle 40 is preferably constructed of a durable noncorrosive material such as galvanized steel, chrome, or stainless steel. Furthermore, the handle 40 is positioned on the utility carry all 10 in an orientation which allows the device to be carried in a balanced manner so that the utility carry all does not tilt from one side or the other when loaded with cleaning supplies and when carried by the handle.

Figure 3:
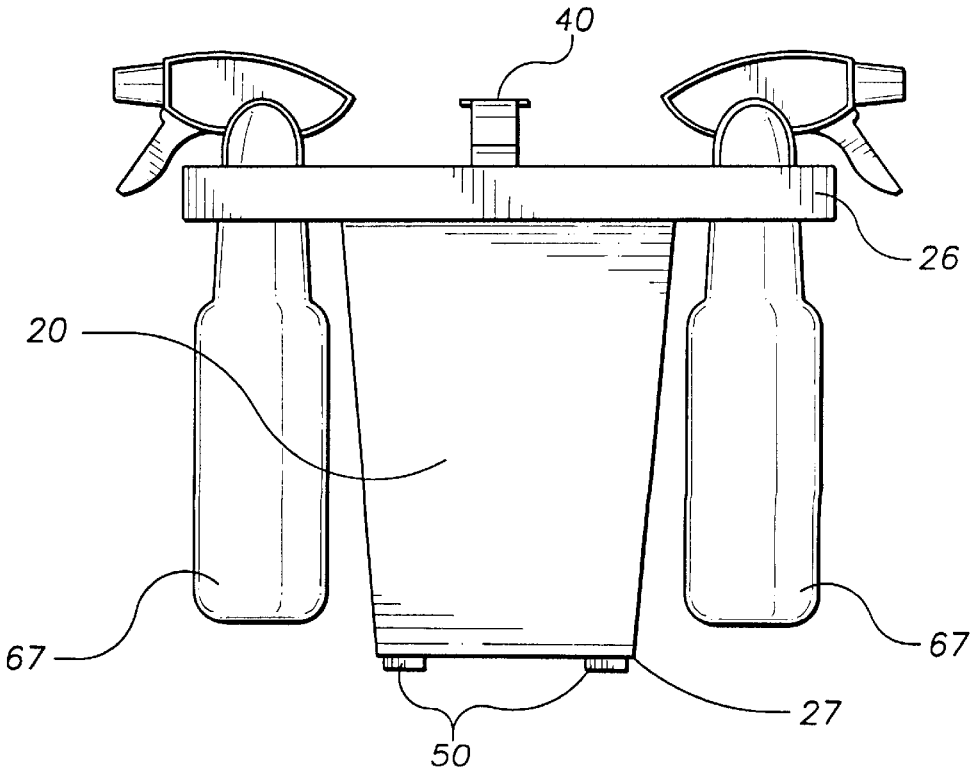
FIG. 3 is an end view of the utility carry all illustrating the placement of the spray bottles in the bottle neck inserts.

The top edge 24 of the central container 20 includes an extended portion 25 which extends planarly from the top edge 24 and is extended from the sides 23 top edges 24 to form numerous built-in apertures through the extended portion 25 which serve as bottle mounts 30. The extended portion 25 includes a vertical perimeter skirt 26 which extends down approximately one inch from the extended portion top surface and provides rigidity and structural integrity to the carry all device and the extended portion 25 and the bottle mounts 30. The bottle mounts 30 include a grooved aperture 31 which has a diameter sufficiently large to allow the insert of numerous size bottle necks. Bottle neck inserts 60 fit within the spray bottle mounts 30 and are provided in numerous sizes to accommodate numerous bottle neck diameters. The bottle neck inserts 60 include a shoulder 61, an extended cylindrical body 64 which extends about one inch from the shoulder 61, an internal diameter 62 which is slightly larger than the outer diameter of the bottle neck to be retained within the bottle mount 30, an outside diameter 63 which is dimensioned to be snugly received by any bottle mount 30, and a insert groove 65 extending the length of the bottle neck insert 60 and providing an entry passageway for a bottle neck into the bottle neck insert 60. The insert groove 65 has a width 66 which is slightly narrower than the outside diameter of a bottle to be retained with the bottle mount 30. The insert is preferably constructed of resilient material so that the insert will give way to allow the bottle to be inserted with a moderate amount of force. The bottle mount 30 includes a groove 32 which is in alignment with the insert groove 65 and provides an entry passage way of a bottle neck into the aperture 31. The groove further includes beveled edges 33 on both sides of the groove to direct the insertion of the bottle neck into the aperture 31. The bottle neck inserts 60 are inserted into the bottle mount 30 be pushing the insert, cylindrical extension body 64 first, into the bottle mount aperture 31. Numerous bottle neck inserts are provided with the carry all 10 with various internal diameters 62 and groove widths 66 to allow a user to insert the appropriate bottle neck insert for a given bottle neck size. FIG. 3 illustrates the placement of bottles 67 into the bottle mounts 30.

The rubber pad feet 50 are attached to a bottom surface 27 of the central container 20. There are preferably four rubber feet if the central container 20 is dimensioned as a rectangle as set forth herein, additional feet may be used. The feet 50 help prevent inadvertent displacement of the utility carry all 10 when the device is positioned on an uneven and slipper surface.

It is noted that the embodiment of the Utility Carry All described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Utility Carry All comprising:

a) a centrally located rectangular water tight container with an open top, a front end, a rear end, two sides, a bottom surface, and a top edge extending from both sides and ends;

b) a horizontal planer extension member extending from the top edge of the central container with a number of grooved bottle mount apertures positioned in line and parallel with each side top edge of the central container and formed within a perimeter edge of the extension member, a continuous vertical skirt member extending vertically from an extension member perimeter edge and extending downwardly about one inch and further extending horizontally around the perimeter edge of the extension member;

c) a number of bottle neck inserts each comprising a cylindrical body with a shoulder portion at one end of the body and a groove extending the length of the body, the cylindrical body has a bore with an internal diameter which is dimensioned to loosely receive a neck of a bottle, the groove has a width which tightly allows the neck of a bottle to pass into the cylinder bore, the cylindrical body has an outside diameter dimensioned to be snugly received by any one of the grooved bottle mount apertures, the groove in the bottle mount aperture aligns with the cylindrical body groove when the cylindrical body is inserted in the body mount aperture while the cylindrical body shoulder assures the cylindrical body will not be pushed through the bottle mount aperture, the cylindrical body has a length about equal to the vertical skirt member vertical length;

d) a number of rubber pad feet attached to a bottom surface of the central container; and e) a handle looping over the central container and extending from the front end top edge to the back end top edge and positioned so that the carry all is balanced when carried by the handle.

2. The Utility Carry All of claim 1, wherein the grooved bottle mount apertures further comprise: three grooved bottle mount apertures located in line on each side of the central container and wherein the grooves for the apertures have beveled edges which facilitates insertion of a bottle neck into the groove and into the bore of the bottle neck insert cylindrical body.

3. The Utility Carry All of claim 1, wherein the bottle neck inserts further comprise: a number of bottle neck inserts provided with the utility carry all with various internal diameter bores and groove widths to correspond to different bottle neck sizes so that a user may insert a bottle neck insert into the grooved bottle mount with an appropriate bore diameter and groove width to fit a given bottle neck size.

4. The Utility Carry All of claim 1 wherein the rubber pad feet further comprise: four rubber pad feet attached to a bottom surface of the central container.

5. The Utility Carry All of claim 1 wherein the handle further comprises a contoured hand grip centrally located on the handle providing a comfortable grip for the user.

* * * * *